United States Patent [19]

Bowman

[11] 4,236,358

[45] * Dec. 2, 1980

[54] ADJUSTABLE MANHOLE COVER SUPPORT STRUCTURE

[75] Inventor: Harold M. Bowman, Fairview Park, Ohio

[73] Assignee: National Utility Products Company, Cleveland, Ohio

[ * ] Notice: The portion of the term of this patent subsequent to Jul. 13, 1993, has been disclaimed.

[21] Appl. No.: 934,213

[22] Filed: Aug. 16, 1978

Related U.S. Application Data

[63] Continuation of Ser. No. 689,088, May 24, 1976, abandoned, which is a continuation-in-part of Ser. No. 494,817, Aug. 5, 1974, Pat. No. 3,968,600, which is a continuation of Ser. No. 286,115, Sep. 5, 1972, abandoned.

[51] Int. Cl.[3] ..... E02D 29/14

[52] U.S. Cl. ..... 52/19; 404/26

[58] Field of Search ..... 52/19, 20, 21; 404/26

[56] References Cited

U.S. PATENT DOCUMENTS

| | | | |
|---|---|---|---|
| 3,326,100 | 6/1967 | White | 404/26 |
| 3,773,428 | 11/1973 | Bowman | 404/26 |
| 3,891,337 | 6/1975 | McCoy | 404/26 |
| 3,968,600 | 7/1976 | Bowman | 404/26 X |

FOREIGN PATENT DOCUMENTS

| | | |
|---|---|---|
| 395078 | 3/1938 | Canada . |
| 588111 | 12/1959 | Canada . |
| 864247 | 2/1971 | Canada . |

*Primary Examiner*—James A. Leppink
*Assistant Examiner*—Carl D. Friedman
*Attorney, Agent, or Firm*—Baldwin, Egan, Walling & Fetzer

[57] ABSTRACT

An adjustable manhole cover support structure including a peripheral frame adapted for placement in the opening of a manhole housing, a peripheral manhole adjusting ring portion disposed on the frame, and a lateral support ring portion disposed on the adjusting ring. The adjusting ring portion has a peripheral inner seat for receiving the manhole cover. The lateral support ring portion is formed as a unit with the adjusting ring portion and projects generally rigidly upwardly therefrom to restrain the adjusted and elevated manhole cover against lateral movement relative to the frame.

12 Claims, 2 Drawing Figures

ADJUSTABLE MANHOLE COVER SUPPORT STRUCTURE

This is a continuation patent application of pending U.S. Pat. application Ser. No. 689,088 filed May 24, 1976 in the name of Harold M. Bowman, now abandoned, and entitled Adjustable Manhole Cover Support Structure which is a continuation-in-part patent application of U.S. Pat. application Ser. No. 494,817, filed Aug. 5, 1974, (now U.S. Pat. No. 3,968,600 issued July 13, 1976) which in turn is a continuation patent application of U.S. Ser. No. 286,115, filed Sept. 5, 1972 and now abandoned.

This invention relates to manhole cover supports and more particularly to an adjustable support for varying the height of the cover and includes a lateral support ring to maintain the cover in generally fixed horizontal position.

In the repair and resurfacing of streets and highways, it is frequently found that the repaired or resurfaced roadway is substantially higher than the original roadway with the result that the upper edges of numerous manhole housings are disposed substantially below the new road surface. The upper end portions of the housings carry annular, inwardly projecting flanges just below the upper edges thereof for supporting manhole covers and such covers are disposed below the resurfaced roadway, thereby creating hazardous driving conditions unless some means is provided for raising the levels of the covers. Prior adjustable supports also lacked means for retaining the cover in fixed horizontal position.

An object of the invention is to provide a vertically adjustable manhole cover support whereby a manhole cover can be raised to the level of a newly resurfaced road.

Another object is to provide a manhole cover support of the above type having means for mounting it on a conventional manhole housing.

A further object of the invention is to provide a manhole cover support of the above type having means to restrain lateral movement of the cover.

A further object of the invention is to provide a manhole cover support of the above type that is simple in construction, inexpensive to manufacture, and highly effective in operation.

Briefly, the foregoing objects are accomplished by the provision of a manhole cover support for vertically adjusting the level of an associated manhole cover in the opening of a manhole housing including a manhole frame adapted to be fixed in the opening, a unitary peripheral manhole adjusting ring portion disposed on the frame and having a peripheral seat formed in its interior peripheral surface for receiving the manhole cover, and a lateral support ring portion formed as a unit with and rigidly projecting upwardly from the adjusting ring portion to retain the cover in fixed horizontal position. The ring portions are preferably formed by casting as a unit.

Other objects and advantages of the invention will be apparent from the following description taken in conjunction with the drawings wherein.

In the drawings, like numbers refer to like parts.

Figure 1:
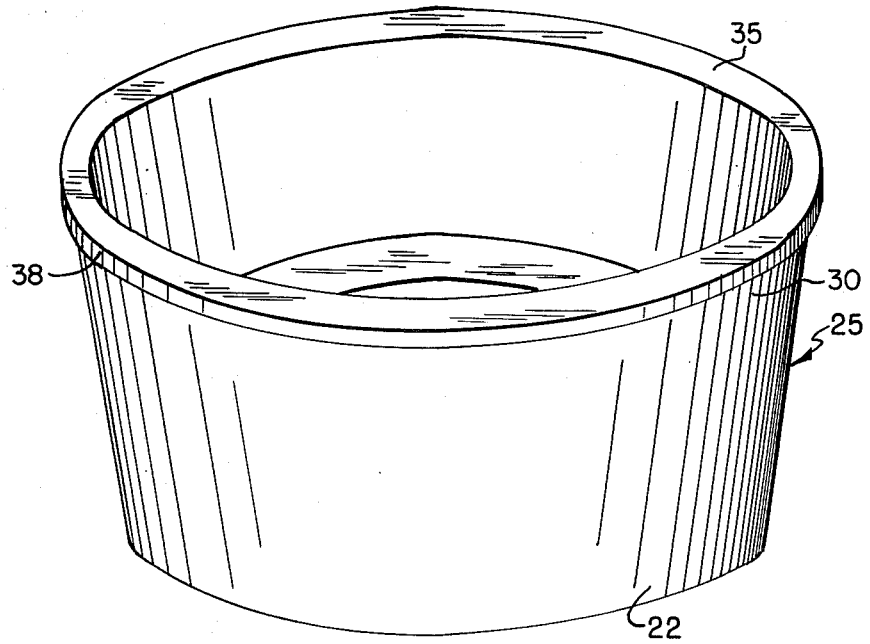
FIG. 1 is a perspective view of a lateral support ring portion and adjusting ring portion formed integrally as a unit for the adjustable manhole cover support structure of the invention.

Referring again to the drawings, there is shown a manhole cover support including a manhole frame 20, and a unitary peripheral manhole adjusting ring portion 22 disposed on the frame seat or shoulder 23 and having a seat 24 formed on its upper surface for receiving a manhole cover 26 thereon. Frame 20 includes an upwardly projecting collar-like portion 27 generally circumscribing seat or shoulder 23 and defining the manhole opening in frame 20.

Normally, the manhole cover 26 rests on the frame seat or shoulder 23 and substantially completely fills the manhole opening in frame 20, except for predetermined generally unobstructed clearance conventionally provided between the cover 26 and the confronting interior surface 28 of the collar portion 27. When the street is paved and the pavement thus raised, the manhole cover is raised by placing the member 25 comprising adjusting ring portion 22 and upwardly projecting lateral support ring portion 30, on the seat 23 and then placing the cover 26 on the ring portion 22.

To prevent or restrict lateral movement of the cover 26, lateral support ring portion 30 is provided. More specifically, the invention provides a manhole cover support structure for vertically adjusting the level of an associated manhole cover 26 in the opening of a manhole housing including a manhole frame 20 adapted to be fixed in the opening, a peripheral manhole adjusting ring portion 22 disposed on the frame 20 and having a peripheral upper seat 24 formed on its top surface for receiving the manhole cover 26. The manhole cover 26 is spaced slightly inwardly of the frame 20 to form a peripheral space 34 between the manhole cover 26 and the frame 20. The lateral support ring portion 30 is disposed in such peripheral space 34 to retain the manhole cover 26 in fixed horizontal position. In the adjusted, elevated condition of the cover relative to shoulder 23 of the frame, the top surface **26*a* of the cover and the top surface 35 of the ring portion 30 are preferably at substantially the same level, with surface 35 being disposed in elevated condition with respect to top surface 20*a* of frame 20, and as shown in FIG. 2**.

Figure 2:
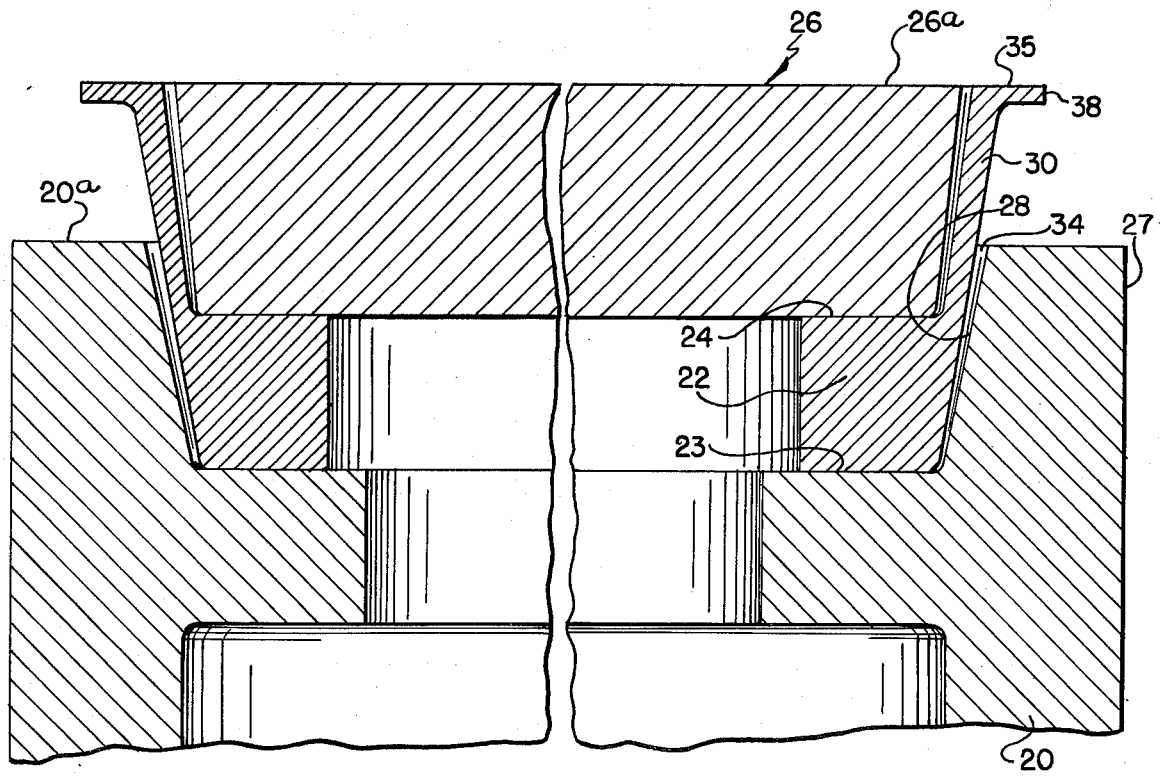
FIG. 2 is a vertical sectional view of an adjustable manhole cover support structure incorporating the unitary support ring portion and adjusting ring portion of FIG. 1.

The lateral support ring portion 30 may have a flange 38 extending outwardly from its upper edge, whereby such lateral support ring portion is of inverted L-shape in transverse section as best shown in FIGS. 1 and 2, such shape providing increased load bearing strength.

It will be understood that the frame, cover and ring portions aforedescribed may be rectangular in plan view rather than circular as illustrated.

Thus there is provided a manhole height adjusting means of simple, economical construction that may be very easily operated by the man in the field.

With the lateral support ring portion 30 of member 25, the manhole cover 26 is permanently affixed or restrained in horizontal position.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

What is claimed is:

1. A manhole cover support structure to vertically adjust and support a manhole cover in a manhole frame, wherein the manhole frame is supported in a manhole housing and has an upwardly facing shoulder circumscribed by an upwardly projecting collar-like portion defining the manhole opening, said shoulder including a generally upwardly facing, circular-like, in plan surface area, a generally circular, in plan manhole cover normally engaged with and supported on said surface area of said shoulder, with said cover substantially completely filling said opening, except for predetermined generally unobstructed lateral clearance between said cover and the confronting interior surface of said collar-like portion, an adjusting and restraining member comprising a cover adjusting insert portion resting on said surface area of said shoulder and having a circular-like, in plan upper cover supporting surface on which said cover rests in adjusted, elevated position relative to the shoulder of said frame, the outer peripheral edge of said cover spaced laterally from said interior surface of said collar-like portion in said adjusted, elevated position of said cover, and a relatively thin lateral support ring portion integrally formed with and projecting rigidly upwardly from said cover support insert portion and disposed in the last mentioned lateral space between said interior surface of said collar-like portion and said outer edge of said cover, to restrain the cover against lateral movement relative to the frame, the full weight of said cover being supported directly by said upper cover supporting surface of said cover adjusting insert portion in said adjusted elevated position of said cover, and wherein said interior surface of said collar-like portion of said frame slopes downwardly and inwardly terminating at its lower edge at the outer periphery of said shoulder, said collar-like portion having a substantially horizontal top surface, said adjusting insert portion having an outer side surface which tapers inwardly in a downward direction and which last mentioned side surface is disposed in confronting generally closely spaced relation to said interior surface, and said support ring portion including a defining wall structure which on its outer side surface is tapered inwardly in a downward direction and generally complementary to the taper on said outer side surface of said adjusting insert portion, the last mentioned side surface forming a continuation of said outer side surface of said support ring portion and being tapered continuously throughout the vertical extent of said insert portion, said support ring portion having an inner downwardly and inwardly sloped defining side surface, which merges with the outer periphery of said upper cover supporting surface, and said cover comprising an outer defining side surface which is sloped generally complementary to said sloped inner defining side surface of said support ring portion, said cover and support ring portion confronting side surfaces being disposed in generally laterally spaced relation to one another, the diameter of said surface area of said shoulder and of said upper cover supporting surface being substantially identical, the diameter of the bottom surface of said insert portion being substantially identical to said diameter of said upper cover supporting surface, and with the top surfaces of said cover and said support ring portion being disposed at substantially the same elevation and with said top surface of said support ring portion being disposed in elevated condition relative to said top surface of said collar-like portion.

2. A support structure in accordance with claim 1 wherein said lateral support ring portion at its upper edge includes a laterally outwardly extending flange portion adapted for engagement with an adjacent surface to increase the load bearing strength of said support ring portion.

3. A support structure in accordance with claim 1 wherein said support ring portion includes a laterally outwardly projecting flange portion disposed at the upper edge of said defining wall structure thereof, the top surface of said flange portion being generally coplanar with said top surface of said cover, in said adjusted elevated position of said cover.

4. A manhole cover support structure to vertically adjust and support a manhole cover in a manhole frame, wherein the manhole frame is supported in a manhole housing and has an upwardly facing shoulder circumscribed by an upwardly projecting collar-like portion defining the manhole opening, said shoulder including a generally upwardly facing, circular-like surface area, a generally circular, in plan, manhole cover normally engaged with and supported on said surface area of said shoulder with said cover substantially completely filling said opening, except for predetermined generally unobstructed lateral clearance between said cover and the confronting interior surface of said collar-like portion, an adjusting and restraining member comprising a cover adjusting insert portion resting on said surface area of said shoulder and having a circular-like, in plan, upper cover supporting surface on which said cover rests in adjusted, elevated position relative to the shoulder of said frame, the outer peripheral edge of said cover spaced laterally from said interior surface of said collar-like portion in said adjusted, elevated position of said cover, and a relatively thin lateral support portion integral with and projecting generally rigidly upwardly from said cover support insert portion and disposed in the last mentioned lateral space between said interior surface of said collar-like portion and said outer edge of said cover, to restrain the cover against lateral movement relative to the frame, the full weight of said cover being supported directly by said upper cover supporting surface of said cover adjusting insert portion in said adjusted elevated position of said cover, and wherein said interior surface of said collar-like portion of said frame slopes downwardly and inwardly terminating at its lower edge at the outer periphery of said shoulder, said collar-like portion having a substantially horizontal top surface, said support portion including defining wall structure which on its outer side surface is tapered inwardly in a downward direction and generally complementary to the taper on said interior surface of said collar-like portion, said support portion having an inner downwardly and inwardly sloped defining side surface, which merges with the outer periphery of said upper cover supporting surface, and said cover comprising an outer defining side surface, which is sloped generally complementary to said sloped inner defining side surface of said support portion, said cover and support portion confronting side surfaces being disposed in generally laterally spaced relation to one another, the diameter across said upper cover supporting surface being substantially identical to the diameter across said surface area, and with the top surfaces of said cover and said support portion being disposed in elevated condition relative to said top surface of said collar-like portion.

5. A support structure in accordance with claim 4 wherein said support portion projects upwardly from said insert portion adjacent the outer periphery of said upper cover supporting surface.

6. A manhole cover support structure to vertically adjust and support a manhole cover in a manhole frame, wherein the manhole frame is supported in a manhole housing and has an upwardly facing shoulder circumscribed by an upwardly projecting collar-like portion defining the manhole opening, said shoulder including a generally upwardly facing surface area, a manhole cover normally engaged with and supported on said surface area of said shoulder with said cover substantially completely filling said opening, except for predetermined generally unobstructed lateral clearance between said cover and the confronting interior surface of said collar-like portion, an adjusting and restraining mechanism comprising a cover adjusting insert portion resting on said surface area of said shoulder and having an upper cover supporting surface on which said cover rests in adjusted, elevated position relative to the shoulder of said frame, the outer peripheral edge of said cover spaced laterally from said interior surface of said collar-like portion in said adjusted, elevated position of said cover, and a relatively thin lateral support portion projecting upwardly from said cover insert portion and disposed in the last mentioned lateral space between said interior surface of said collar-like portion and said outer edge of said cover, to restrain the cover against lateral movement relative to the frame, the full weight of said cover being supported directly by said upper cover supporting surface of said cover adjusting insert portion in said adjusted elevated position of said cover, and wherein said interior surface of said collar-like portion of said frame slopes downwardly and inwardly terminating at its lower edge at the outer periphery of said shoulder, said collar-like portion having a substantially horizontal top surface, said support portion including defining wall structure which on its outer side surface is tapered inwardly in a downward direction and generally complementary to the taper on said interior surface of said collar-like portion, said support portion having an inner downwardly and inwardly sloped defining side surface which merges with the outer periphery of said upper cover supporting surface, and said cover comprising an outer defining side surface which is sloped generally complementary to said sloped inner defining side surface of said support portion, said cover and support portion confronting side surfaces being disposed in generally laterally spaced relation to one another, the edge-to-edge dimension across said upper cover supporting surface being substantially identical to the edge-to-edge dimension across said surface area of said shoulder, and with the top surfaces of said cover and said support portion being disposed in elevated condition relative to said top surface of said collar-like portion.

7. A support structure in accordance with claim 6 wherein said adjusting insert portion has an outer side surface which tapers inwardly in a downward direction, and which last mentioned side surface is disposed in confronting generally closely spaced relation to said interior surface of said collar-like portion.

8. A support structure in accordance with claim 6 wherein said cover includes a top surface which is disposed at substantially the same elevation as the top surface of said support portion.

9. A manhole cover adjusting and restraining mechanism for use in a manhole cover support structure to vertically adjust and support an associated manhole cover in a manhole frame, and wherein the manhole frame has an upwardly facing shoulder circumscribed by an upwardly projecting collar-like portion defining the manhole opening, and wherein said shoulder includes a generally upwardly facing surface area with the manhole cover normally engageable with and supported on the surface area of the shoulder of the frame with the cover substantially completely filling the manhole opening, except for predetermined generally unobstructed lateral clearance between the cover and the confronting interior surface of the collar-like portion of the frame, said adjusting and restraining mechanism comprising a cover adjusting insert portion adapted to rest on the surface area of the frame shoulder and having an upper cover supporting surface on which the cover is adapted to rest in adjusted, elevated position relative to the shoulder of the manhole frame, the outer peripheral edge of the cover being adapted to be spaced laterally from the interior surface of the collar-like portion in the adjusted, elevated position of the cover, said adjusting and restraining mechanism including a relatively thin lateral support portion integral with and projecting generally rigidly upwardly from said cover insert portion and adapted to be disposed in the lateral space between the interior surface of the collar-like portion of the frame and the outer edge of the cover, to restrain the cover against lateral movement relative to the frame, the full weight of the cover being adapted to be supported directly by said upper cover supporting surface of said cover adjusting insert portion in the adjusted elevated position of the cover, and wherein the interior surface of the collar-like portion of the frame slopes downwardly and inwardly terminating at its lower edge at the outer periphery of the shoulder of the frame, the collar-like portion having a substantially horizontal top surface, said support portion including defining wall structure which on its outer side surface is tapered inwardly in a downward direction for generally complementary confronting orientation to the taper on the interior surface of the collar-like portion of the frame, said support portion having an inner downwardly and inwardly sloped defining side surface which merges with the outer periphery of said upper cover supporting surface, for generally complementary orientation to the outer side defining surface of the cover, the support portion inner side surface being adapted to be disposed in generally laterally spaced confronting relation to the outer side surface of the cover, the edge-to-edge dimension across said upper cover supporting surface being substantially identical to the edge-to-edge dimension across the surface area of the frame shoulder, and with the top surface of said support portion being adapted to be disposed in elevated condition relative to the top surface of the collar-like portion of the frame.

10. A manhole cover adjusting and restraining mechanism in accordance with claim 9 wherein said adjusting insert portion has an outer side surface which tapers inwardly in a downward direction and forms a continuation of the slope of said outer side surface of said support portion, said slope of the last mentioned side surface extending continuously through the vertical extent of said insert portion.

11. A manhole cover adjusting and restraining mechanism in accordance with claim 10 wherein the edge-to-edge dimension across the bottom surface of said adjusting insert portion is substantially identical to said edge-to-edge dimension across said upper cover supporting surface.

12. A manhole cover adjusting and restraining mechanism for use in a manhole cover support structure to vertically adjust and support an associated manhole cover in a manhole frame, and wherein the manhole frame has an upwardly facing shoulder circumscribed by an upwardly projecting collar-like portion defining the manhole opening, and wherein the shoulder includes a generally upwardly facing surface area with the manhole cover normally engageable with and supported on the surface area of the shoulder of the frame with the cover substantially completely filling the manhole opening, except for predetermined generally unobstructed lateral clearance between the cover and the confronting interior surface of the collar-like portion of the frame, said adjusting and restraining mechanism comprising a cover adjusting insert portion adapted to rest on the surface area of the frame shoulder and having an upper cover supporting surface on which the cover is adapted to rest in adjusted, elevated position relative to the shoulder of the manhole frame, the outer peripheral edge of the cover being adapted to be spaced laterally from the interior surface of the collar-like portion in the adjusted, elevated position of the cover, said adjusting and restraining mechanism including a relatively thin lateral support portion projecting upwardly from said cover insert portion and adapted to be disposed in the lateral space between the interior surface of the collar-like portion of the frame and the outer edge of the cover, to restrain the cover against lateral movement relative to the frame, the full weight of the cover being adapted to be supported directly by said upper cover supporting surface of said cover adjusting insert portion in the adjusted elevated position of the cover, and wherein the interior surface of the collar-like portion of the frame slopes downwardly and inwardly terminating at its lower edge at the outer periphery of the shoulder of the frame, the collar-like portion have a substantially horizontal top surface, said support portion including defining wall structure which on its outer side surface is tapered inwardly in a downward direction for generally complementary confronting orientation to the taper on the interior surface of the collar-like portion of the frame, said support portion having an inner downwardly and inwardly sloped defining side surface which merges with the outer periphery of said upper cover supporting surface, for generally complementary orientation to the outer side defining surface of the cover, the support portion inner side surface being adapted to be disposed in generally laterally spaced confronting relation to the outer side surface of the cover, the edge-to-edge dimension across said upper cover supporting surface being adapted to be substantially identical to the edge-to-edge dimension across the surface area of the frame shoulder, and with the top surface of said support portion being adapted to be disposed in elevated condition relative to the top surface of the collar-like portion of the frame.

* * * * *